United States Patent [19]

Ishikawa et al.

[11] Patent Number: 5,049,842

[45] Date of Patent: Sep. 17, 1991

[54] DIELECTRIC RESONATOR HAVING A CUTOUT PORTION FOR RECEIVING AN UNITARY TUNING ELEMENT CONFORMING TO THE CUTOUT SHAPE

[75] Inventors: Youhei Ishikawa; Hidekazu Wada; Kouichi Takehara; Toru Tanizaki; Shigeji Arakawa; Shinichi Kunioka, all of Nagaokakyo, Japan

[73] Assignee: Murata Mfg. Co., Ltd., Japan

[21] Appl. No.: 271,603

[22] Filed: Nov. 15, 1988

[30] Foreign Application Priority Data

Nov. 17, 1987 [JP] Japan ..... 62-291586

[51] Int. Cl.[5] ..... H01P 7/10

[52] U.S. Cl. ..... 333/235; 333/219.1

[58] Field of Search ..... 333/235, 234, 219.1, 333/202

[56] References Cited

U.S. PATENT DOCUMENTS 4,728,913 3/1988 Ishikawa et al. ..... 333/219.1 X

FOREIGN PATENT DOCUMENTS 136302 6/1986 Japan ..... 333/234

166602 7/1987 Japan ..... 333/235

271503 11/1987 Japan ..... 333/234

263802 10/1988 Japan ..... 333/219.1

*Primary Examiner*—Eugene R. LaRoche

*Assistant Examiner*—Benny T. Lee

*Attorney, Agent, or Firm*—Ostrolenk, Faber, Gerb & Soffen

[57] ABSTRACT

This dielectric resonator comprises a cylindrical hollow case made of metal, a cylindrical hollow dielectric resonator element which is fixed and held in the case, and a dielectric tuning unit which is inserted into or withdrawn from a hollow portion of the dielectric resonator element. The hollow portion of the dielectric resonator element is formed by at least one, or a plurality of, cutout portions which extend along respective radii of the cylindrical dielectric resonator. In this dielectric resonator, the overall effective dielectric constant as a whole can be varied by inserting the tuning unit into or withdrawing it from the hollow portion of the dielectric resonator element. When the tuning unit is withdrawn from the hollow portion of the dielectric resonator element, part of an electric field path at the dielectric resonator element is interrupted by the cutout portions.

16 Claims, 2 Drawing Sheets

DIELECTRIC RESONATOR HAVING A CUTOUT PORTION FOR RECEIVING AN UNITARY TUNING ELEMENT CONFORMING TO THE CUTOUT SHAPE

BACKGROUND OF THE INVENTION

1. Field of the Invention

This invention relates to a dielectric resonator and, more particularly, to a dielectric resonator which utilizes the TE mode.

2. Description of the Prior Art

One example of a conventional dielectric resonator in the background of this invention has been disclosed, for example, in the specification of U.S. Pat. No. 4,728,913. This conventional dielectric resonator is provided with a dielectric tuning unit which is capable of being inserted into or withdrawn from a hollow portion of a cylindrical hollow dielectric resonator element.

In this conventional dielectric resonator, the rate of change of resonance frequency is comparatively large. However, an even wider range of resonance frequency adjustment is required.

SUMMARY OF THE INVENTION

A principal object of the present invention is, therefore, to provide a dielectric resonator whose resonance frequency can be adjusted within a wider range than before.

This invention provides a dielectric resonator which comprises a case, a cylindrical hollow dielectric resonator element fixed and held in the case, and a dielectric tuning unit which is inserted into or withdrawn from a hollow portion of the dielectric resonator element, wherein the hollow portion includes a cutout portion which extends in a diameter direction along a diameter of the dielectric resonator element.

In this dielectric resonator, when the tuning unit is withdrawn from the hollow portion of the dielectric resonator element, part of a path of an electric field at the dielectric resonator element is interrupted by the cutout portion. Therefore, the effective dielectric constant of the dielectric resonator element decreases as compared with that of the conventional structure, and this results in an increase in the variation of an effective dielectric constant as a whole.

According to the present invention, the variation of the effective dielectric constant can be increased as a whole as compared with that of the conventional structure. Therefore, the resonance frequency can be adjusted within a wider range than before.

The above and other objects, features, aspects and advantages of this invention will be more apparent from the detailed description of the following embodiments when taken in conjunction with the accompanying drawings.

BRIEF DESCRIPTION OF THE DRAWINGS

FIG. 1A is an illustrated cross section view of the embodiment and FIG. 1B is an illustrated vertical section view of it.

DESCRIPTION OF PREFERRED EMBODIMENTS

Figure 1A:
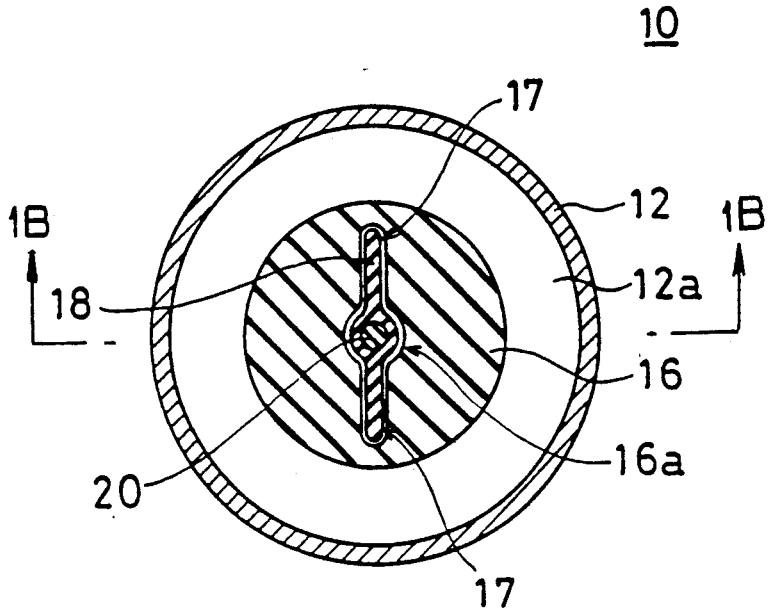
FIGS. 1A and 1B show one embodiment of the present invention, where
Figure 1B:
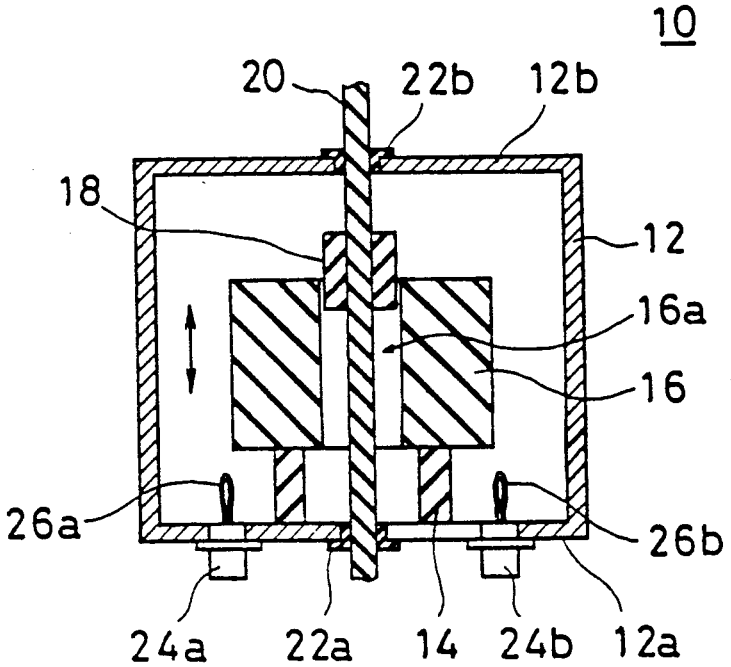

FIG. 1A and 1B show one embodiment of the present invention, where FIG. 1A is an illustrated cross section view of the embodiment and FIG. 1B is an illustrated vertical section view of it. This dielectric resonator 10 comprises a cylindrical hollow case 12 made of, for example, metal.

A cylindrical hollow supporting stand 14 (see FIG. 1B) made of a material of a low dielectric constant is provided on a bottom plate 12*a* of the case 12 at nearly the center of it. Further, a cylindrical dielectric resonator element 16 made of a high dielectric constant material such as ceramic is fixed on the supporting stand 14. Thus, the dielectric resonator element 16 is fixedly held within an outer case 12. As a whole, the dielectric resonator 10 is formed which utilizes the $TE_{01\delta}$ mode.

In the center of this dielectric resonator element 16, a column shaped space is formed and in this space two cutout portions 17 are formed, each having a V-shaped cross section, extending in opposite directions along a diameter of the cylindrical dielectric resonator element 16 communicating with each other. That is, a hollow portion 16*a* defined within the dielectric resonator element 16 comprises the two cutout portions 17 extending in the opposite directions along the above-mentioned diameter of the dielectric resonator element 16.

The hollow portion 16*a* of the cylindrical hollow dielectric resonator element 16, has a tuning unit 18 inserted into it, which is made of a high dielectric constant material such as ceramic. The outer shape of this tuning unit 18 is made substantially the same as, but smaller than, the inner shape of the hollow portion 16*a* of the dielectric resonator element 16. Thus, the tuning unit 18 can move in the directions indicated by arrows in FIG. 1B without touching the inner peripheral surface of the hollow portion 16*a* of the dielectric resonator element 16.

A supporting axis 20 made of a relatively low dielectric constant material such as ceramic is inserted into a hollow portion of the tuning unit 18, at which portion the supporting axis 20 and the tuning unit 18 are fixed. Thus, by moving the supporting axis 20 axially, the tuning unit 18 is transferred in the directions indicated by the arrows in FIG. 1B. The bottom and top portions of the supporting axis 20 are respectively positioned at a penetrating hole of the bottom plate 12*a* and a penetrating hole of the top plate 12*b* of the case 12 by bushings 22*a* and 22*b* (see FIG. 1B) made of a low dielectric constant resin such as Teflon (Trademark) and are so supported that the axis 20 can move smoothly in the directions indicated by the arrows in FIG. 1B.

Still referring to FIG. 1B, the bottom plate 12*a* of the case 12 is provided with coaxial connectors 24*a* and 24*b* therethrough for input and output. Further, within the case 12, respective first ends of loop shape conductors 26*a* and 26*b* are connected to the inner conductors of the coaxial connectors 24*a* and 24*b*, and respective second ends thereof are connected to the case 12 to ground so that an external circuit can be magnetically coupled to the dielectric resonator element 16 through the conductors 26*a* and 26*b*.

In this dielectric resonator 10, when the supporting axis 20 is axially moved, the tuning unit 18 made of dielectric material is transferred in the directions indicated by the arrows in FIG. 1B, so as to be inserted farther into or withdrawn from the hollow portion 16a of the dielectric resonator element 16. As a result, an effective dielectric constant is varied as a whole, and thus a resonant frequency can be varied. In this case, when the tuning unit 18 is inserted into the hollow portion 16a of the dielectric resonator element 16, the effective dielectric constant of the dielectric resonator 10 increases as a whole, and this results in decrease in a resonance frequency. On the other hand, when the tuning unit 18 is withdrawn from the hollow portion 16a of the dielectric resonator element 16, part of an electric field path at the dielectric resonator element 16 is interrupted by the two cutout portions 17. Therefore the effective dielectric constant of the dielectric resonator element 16, that is, the effective dielectric constant as a whole, decreases as compared with that of the conventional structure, and this results in increase in a resonance frequency. That is, in the dielectric resonator 10, the variation of the effective dielectric constant can be increased as a whole as compared with that of the conventional structure, and therefore, the resonance frequency can be adjusted within a wider range.

Further, an electric field distribution in the dielectric resonator element 16 when the dielectric tuning unit is removed is the most intense at about the center of the thickness of each radial portion of the dielectric resonator element 16. That is, the distribution is the most intense at about halfway between the inside cylindrical axial surface and outside surfaces of the dielectric resonator element 16 when the dielectric tuning unit is removed. In this dielectric resonator 10, because the cutout portions 17 are extended to about halfway between the inner cylindrical axial surface and the outer surface, it cuts the contour to the most intense field distribution, so the variation of the resonance frequency that is obtainable can be effectively increased.

In the conventional structures, the tuning unit is only an axis-symmetrical cylinder, and therefore, electric energy generated by a rotating electric field tends to accumulate in the tuning unit. As a result, in the conventional structures, when the tuning unit is withdrawn from the hollow portion of the dielectric resonator element, energy due to the electric field tends to distribute more on the tuning unit side and thus a magnetic field also tends to distribute more on that side, resulting in increase in Joule's loss of the case end surface, whereby $Q_0$ is slightly decreased.

However, in the dielectric resonator 10, the tuning unit 18 is not a mere cylinder but rather has a varying radius although symmetrical about its axis. Thus the electrical energy due to the rotating electric field shows almost no tendency to accumulate. Therefore, in the dielectric resonator 10, when the tuning unit 18 is withdrawn from the hollow portion 16a of the dielectric resonator element 16, the energy due to the electric field and the magnetic field are scarcely distributed whereby $Q_0$ is scarcely reduced.

Figure 2:
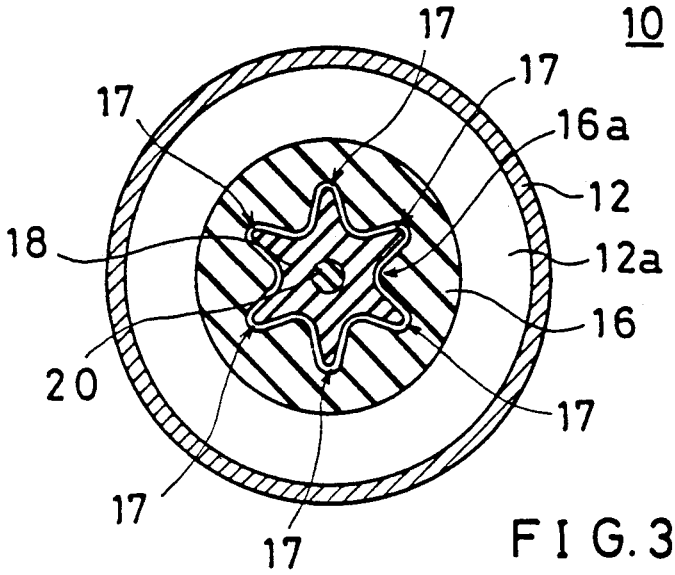
FIG. 2 is an illustrated cross section view showing a modification of the embodiment of FIGS. 1A and 1B.

FIG. 2 is an illustrated cross section view showing a modification of the embodiment of FIGS. 1A and 1B. In this embodiment, six cutout portions 17 each with a nearly U-shaped cross section are formed which are extended radially with respect to the axis 20, along radii of a dielectric resonator element 16. The outer shape of a tuning unit 18 is formed somewhat smaller than but corresponding to the inner shape of a hollow portion 16a of the dielectric resonator element 16. That is, the hollow portion 16a formed in the dielectric resonator element 16 comprises six cutout portions 17 which extend radially. When the number of the cutout portions 17 of the dielectric resonator element 16 is thus increased, the number of a places at which an electric field path of the dielectric resonator element 16 is interrupted increases when the tuning unit 18 is withdrawn from the hollow portion 16a of the dielectric resonator element 16. As a result, a variation of the effective dielectric constant as a whole and a variation of the resonance frequency can be expanded even more.

Figure 3:
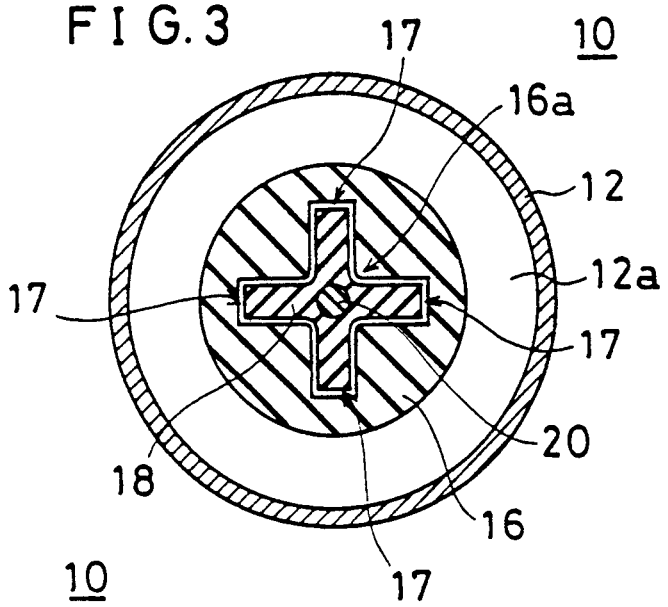
FIG. 3 is an illustrated cross section view showing another embodiment of the present invention.

FIG. 3 is an illustrated cross section view showing another embodiment of the present invention. In this embodiment, a hollow portion 16a of a dielectric resonator element 16 is so formed that it has a cross-shaped cross section. That is, the hollow portion 16a of the dielectric resonator element 16 comprises four cutout portions 17, each having a with rectangular cross section.

Figure 4:
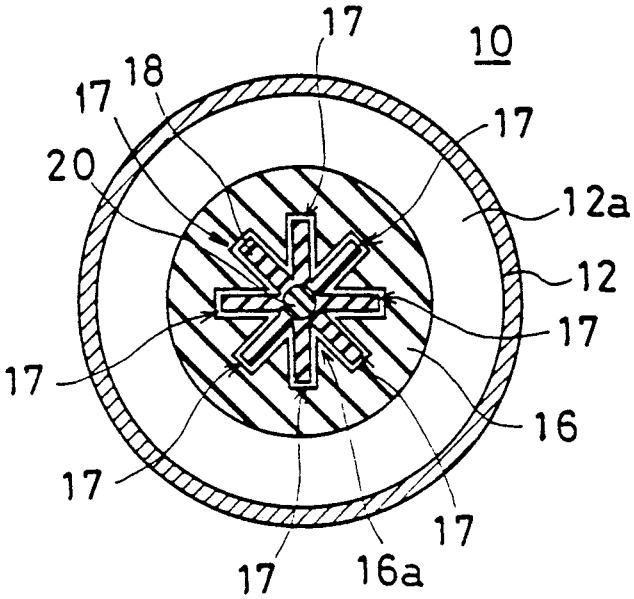
FIG. 4 is an illustrated cross section view showing a modification of the embodiment of FIG. 3.

FIG. 4 is an illustrated cross section view showing a modification of the embodiment of FIG. 3. As compared with the embodiment of FIG. 3, in this embodiment, eight cutout portions 17 are formed, each having a rectangular cross section, and are extended radially, along radii of a dielectric resonator element 16.

As mentioned above, the shape or the number of the cutout portions 17 may be varied. In each case, the outer shape of the tuning unit 18 should correspond to but be formed somewhat smaller than the inner shape of the hollow portion 16a of the dielectric resonator element 16.

Further, in each embodiment mentioned above, the dielectric resonator is formed in a cylinder or a column shape and the dielectric resonator for $TE_{01\delta}$ mode is provided. However, a dielectric resonator element or a case having a polygonal outer shape may be used. In this case, a resonator operation will be in $TE_{01\delta}$ mode.

Although the present invention has been described and illustrated in detail, it is clearly understood that the same is by way of illustration and giving example only and is not to be taken by way of limitation, the spirit and scope of the present invention being limited only by the terms of the appended claims.

What is claimed is:

1. A dielectric resonator comprising:

a case;

input and output means on said case for the input and output of electromagnetic energy;

a cylindrical hollow dielectric resonator element fixed and held in said case and having a hollow axial portion;

said hollow axial portion having a cross-sectional shape which is defined by a cylindrical portion which defines an inside diameter ID of said element, and by at least three radially-directed cutout portions which extend symmetrically from said cylindrical cutout portions which extend symmetrically from said cylindrical portion toward a periphery of said dielectric resonator element; and a unitary dielectric tuning unit which is capable of being axially inserted into or withdrawn from said hollow axial portion of said dielectric resonator element, and has a cross-sectional shape substantially matching the cross-sectional shape of said hollow axial portion including said cutout portions;

wherein said periphery of said cylindrical dielectric resonator element defines an outside diameter OD, and said cutout portions extend radially outward from said cylindrical portion more than halfway to said periphery, thereby defining a cutout diameter CD, wherein CD>(ID+OD)/2, whereby said cutout portions interrupt a region of maximum electrical field intensity within said dielectric resonator element which exists when said tuning unit is present in said hollow axial portion.

2. A dielectric resonator in accordance with claim 1, wherein said resonator element has two ends, and said cutout portions extend substantially between said two ends.

3. A dielectric resonator in accordance with claim 2, further comprising means for moving said tuning unit axially within said hollow portion and maintaining said tuning unit spaced out of contact with said hollow portion.

4. A dielectric resonator in accordance with claim 2, wherein there are four radially-directed cutout portions which define substantially equal angles therebetween.

5. A dielectric resonator in accordance with claim 4, wherein distal ends of said cutout portions furthest toward said periphery of said element are rounded in cross-section.

6. A dielectric resonator in accordance with claim 4, wherein distal ends of said cutout portions furthest toward said periphery of said element are rectangular in cross-section.

7. A dielectric resonator in accordance with claim 2, wherein there are six radially-directed cutout portions which define substantially equal angles therebetween.

8. A dielectric resonator in accordance with claim 7, wherein distal ends of said cutout portions furthest toward said periphery of said element are rectangular in cross-section.

9. A dielectric resonator in accordance with claim 1, wherein said cross-sectional shape of said dielectric tuning unit is substantially the same as but smaller than said cross-sectional shape of said hollow axial portion including said cutout portions.

10. A dielectric resonator comprising:

a case;

input and output means on said case for the input and output of electromagnetic energy;

a cylindrical hollow electric resonator element fixed and held in said case and having a hollow axial portion;

said hollow axial portion having a cross-sectional shape which is defined by a cylindrical portion which defines an inside diameter ID of said element, and by at least three radially-directed cutout portions which extend symmetrically from said cylindrical portion toward a periphery of said dielectric resonator element; and a unitary dielectric tuning unit which is capable of being axially inserted into or withdrawn from said hollow axial portion of said dielectric resonator element, and has a cross-sectional shape substantially matching the cross-sectional shape of said hollow axial portion including said cutout portions.

11. A dielectric resonator in accordance with claim 10, wherein said resonator element has two ends, and said cutout portions extend substantially between said two ends.

12. A dielectric resonator in accordance with claim 10, wherein said cross-sectional shape of said dielectric tuning unit is substantially the same as but smaller than said cross-sectional shape of said hollow axial portion including said cutout portions.

13. A dielectric resonator in accordance with claim 10, further comprising means for moving said tuning unit axially within said hollow portion and maintaining said tuning unit spaced out of contact with said hollow portion.

14. A dielectric resonator in accordance with claim 10, wherein each said cutout portion is formed with a cross section which is at least partially U-shaped.

15. A dielectric resonator in accordance with claim 10, wherein each said cutout portion is formed with a cross section which is at least partially rectangular.

16. A dielectric resonator in accordance with claim 10, wherein said periphery of said cylindrical dielectric resonator element defines an outside diameter OD, and said cutout portions extend radially outward from said cylindrical portion more than halfway to said periphery, thereby defining a cutout diameter CD, wherein CD>(ID+OD)/2, and thereby extending into a region of maximum electrical field intensity within said dielectric resonator element.

* * * * *